United States Patent [19]

Martens et al.

[11] 4,221,025

[45] Sep. 9, 1980

[54] ANTI-THEFT LOCKING DEVICE

[75] Inventors: Henry J. Martens, Lynnfield; Jan Vandebult, Topsfield, both of Mass.

[73] Assignee: I. D. Engineering, Inc., Ipswich, Mass.

[21] Appl. No.: 971,165

[22] Filed: Dec. 20, 1978

[51] Int. Cl.[2] ..... A44B 9/00

[52] U.S. Cl. ..... 24/150 R; 24/155 BR

[58] Field of Search ..... 24/150 R, 155 BR

[56] References Cited

U.S. PATENT DOCUMENTS

| | | | |
|---|---|---|---|
| 1,472,681 | 10/1923 | Roy | 24/155 BR |
| 2,826,855 | 3/1958 | Troccia | 24/155 BR |
| 3,911,534 | 10/1975 | Martens | 24/150 R |

*Primary Examiner*—Kenneth Downey

*Attorney, Agent, or Firm*—Schwartz, Jeffery, Schwaab, Mack, Blumenthal & Koch

[57] ABSTRACT

A locking device which includes a housing, a spring biased insert, arcuately spaced retaining balls, and cup means which is securely mounted in the housing and retains the balls and the lower end of the insert. The tapered side walls of the cup means provide a cam surface upwardly along which the balls can move when a pin is inserted in the lock. When the pin is released the balls tightly frictionally engage the pin under the bias of the spring, thereby preventing unauthorized removal of the pin.

9 Claims, 6 Drawing Figures

ANTI-THEFT LOCKING DEVICE

BACKGROUND OF THE INVENTION

The present invention relates as indicated to an anti-theft locking device, and more particularly to a locking device particularly adapted to be used in a system for preventing unauthorized removal of articles from department stores, boutiques, or the like. In accordance with the invention, the locking device is securely mounted in an identification tag, with the lock being securely attached to articles of merchandise in such a manner that the lock can be opened or separated only by the use of a special tool which can be conveniently located at the checkout point in the department store or similar establishment. The lock tightly frictionally engages a pin which extends through the protected article, with the actuation of the tool permitting the pin to be released and the lock and tag removed from the article for normal purchased items. If a person attempts to surreptitiously remove the article from the store without purchasing the same and consequently effecting removal of the identification tag and lock, the construction of the tag and the complete system permits an alarm system to be actuated at an exit point or points in the store thereby notifying the store operators of the unauthorized removal of the article from the premises.

Locking devices similar in purpose to the locking device of the present invention are disclosed in U.S. Pat. Nos. 3,858,280 to Martin A. J. Martens and 3,911,534 to Henry J. Martens et al. Reference is specificially made to these patents for a complete understanding of the anti-theft system and the specific construction of the identification tag with which the locking device of the present invention is employed. It should be noted in this regard that the identification tag has been disclosed in the present application drawing and will be referred to hereinbelow only for a full understanding of the present invention, with the construction of the tag forming no part thereof. Similarly, the detaching tool by means of which the locking device can be separated from the article secured thereto forms no part of the present invention, and reference is made to U.S. Pat. No. 3,911,534 which discloses a detaching tool which can be satisfactorily employed with the locking device of the present invention.

With regard to known prior art, the most relevant art which applicants are familiar with is the aforesaid U.S. Pat. No. 3,911,534, of which applicants are joint patentees. In the patented fastening device, positioned within the housing or cap of the fastener is an insert containing both a longitudinal opening for receiving the pin and transverse openings for receiving the retaining balls. The latter, upon insertion of the pin into the insert and housing, were cammed against an anular ring frictionally retained within the housing around the insert. Upon insertion of the pin, the insert was caused to move upwardly within the housing against spring bias, with release of the pin preventing the same from being withdrawn due to the tight frictional engagement of the ball surfaces with the pin and the adjacent surfaces of the ring. Removal of the pin was effected by placing the fastening device adjacent the detaching tool which, when actuated, electromagnetically moved the insert, formed of magnetizable material, upwardly in the housing thereby permitting the retaining balls to move upwardly along the cam surface of the ring and out of tight frictional engagement with the pin. The pin and tag with the fastening device could then be removed and separately stored for reuse.

Although the above described structure provided highly satisfactory results in commercial use over an extended period of time, it did possess certain disadvantages in terms of cost both with respect to material parts and also labor costs required to assemble the fastening device.

SUMMARY OF THE PRESENT INVENTION

With the above in mind, a primary object of the present invention is to provide a locking device which can be quickly and easily secured to the articles to be protected, while simultaneously providing a locking arrangement which precludes separation of the pin from the lock without a special detaching tool.

A further object of the invention is to provide such a locking device in which substantial savings of both material and labor are achieved. In accordance with the invention, the insert is substantially shorter and provided with only a single, longitudinal bore. A cup is frictionally retained within an opening provided therefor in the bottom of the housing, and the retaining balls are loosely positioned in the bottom or closed end of the cup, and separated from the insert by a flanged washer. The cup serves the dual purpose of both retaining the insert and the balls, and providing a cam surface along which the balls can upwardly travel during insertion of the pin. When the pin is in position and released, the balls tightly frictionally engage the pin due to spring tension placed on the upper end of the insert, with the spring pressure acting through the insert and the flanged washer and causing the balls to be biased radially inwardly into tight frictional engagement with the pin.

A further object of the invention is to provide a locking device which not only requires a special tool to open or separate, but additionally is essentially tamperproof. The turning of the housing within its mounted position in the identification tag has no effect on the lock since the housing and pin rotate together.

These and other objects of the invention will become apparent when the following description proceeds in particular reference to the application drawing.

BRIEF DESCRIPTION OF THE APPLICATION DRAWING

FIG. 1 comprises a side elevational view of the locking device of the present invention, shown mounted on an identification tag;

DESCRIPTION OF THE PREFERRED EMBODIMENT

Figure 1:
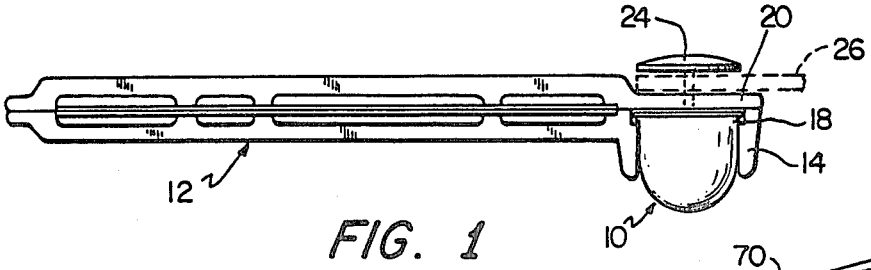

Referring to the application drawing, wherein like parts are indicated by like reference numerals, FIG. 1 illustrates the locking device of the present invention, generally indicated at 10, mounted in a tag assembly generally indicated at 12. As above noted, the tag assembly forms no part of the present invention and can be of comparable construction to the tag assembly disclosed in U.S. Pat. No. 3,911,534. At the end of the tag assembly on which the locking device 10 is mounted, a tubular extension 14 is formed, and the locking device is formed with a radially extending flange 16, best seen in FIG. 2, which extends into an annular recess 18 provided therefor in the tubular extension 14. In this manner, the locking device can be mounted in the tag assembly. The portion 20 of the tag is provided with a recess in which to receive the cup 22 of the lock, shown in dashed lines in FIG. 1 and shown in enlarged form in FIG. 2. The pin 24 is shown in a locked position in FIG. 1, with an article 26 being shown fragmentarily in FIG. 1 between the pin 24 and the locking device. When the article 26 to be purchased is carried to the checkout counter, a detaching tool (not shown) is positioned adjacent the end of the locking device opposite the pin thereby permitting the pin 24 to be withdrawn and the article removed from the tag assembly and lock. If the article 26 to which the tag assembly and lock are attached is attempted to be removed from the premises without authorization, a transmitting circuit contained with the tag 12 functions to actuate detecting equipment normally positioned at each exit of the store thereby to signal the unauthorized removal of the article.

Figure 2:
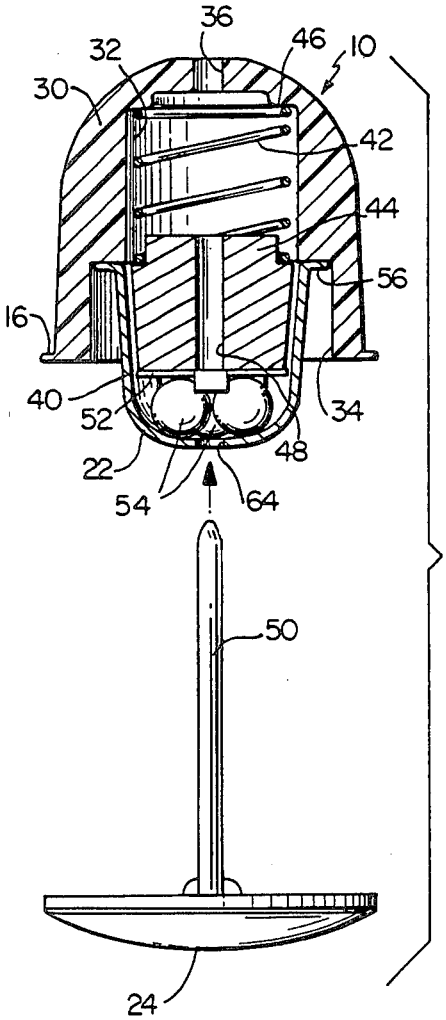
FIG. 2 is an exploded, partially sectioned view of the locking device and pin.

Referring in more detail in FIG. 2, the locking device 10 includes a housing or cap 30 which is preferably molded of plastic material. The cap 30 is formed with a central opening 32 and a relatively enlarged bottom opening 34. In the form shown the otherwise closed end of the cap is provided with an opening 36 through which the pin can extend in the event the pin length is such that it is not fully accommodated within the cap.

An insert generally indicated at 40 is loosely mounted within the cap, and a spring 42 extends around a slightly reduced diameter portion 44 of the insert, with the opposite end of the spring contacting a flat annular surface 46 of the cap. The spring 42 continually biases the insert 40 downwardly, in the orientation of the locking device as shown in FIG. 2.

The insert 40 further includes a main body portion 47 formed with a single longitudinal opening 48 through which the pin shank 50 can extend. Positioned below the insert is a flanged washer 52, and below the flanged washer there are three retaining balls commonly designated at 54. The insert, flanged washer and balls are housed within the cup 22 the open end of which is formed with a radially outwardly extending flange 56 the outer diameter of which is slightly greater than the diameter of the enlarged opening 34 of the cap. As a result when the cup 22 is inserted upwardly into the cap as shown in the assembled position of FIG. 2, it is tightly frictionally retained within the housing. As shown in FIG. 2, the balls 54 normally rest on the bottom of the cup when the locking device is separated from the pin.

The main body portion 47 of the insert 40 is tapered so as not to interfere during movement with the side walls of the cup 22, which are correspondingly tapered. However, close tolerances are not necessary.

The flanged washer 52 is formed with a plurality of downwardly depending arcuately spaced flanges commonly designated at 60 the purpose of which is to keep the retaining balls spaced and separated when the pin shank is inserted in the lock. The balls are thus unable to ride up and over an adjacent ball, which would inhibit or prevent pin retention in the lock. When the pin 24 is disengaged, the balls 54 rest on the bottom of the cup 22.

The cup 22 is formed with an opening 64 in the bottom wall thereof through which the pin shank 50 can extend, with the flanged washer 52 being formed with a similar opening 66 which is aligned both with the opening 64 and the longitudinal opening 48 formed in the insert 40.

The cup 22, due to the curved side wall portions adjacent the bottom of the cup, provides a cam surface for the balls, which can move upwardly along such surface when the pin shank 50 is inserted into the locking device. During such movement, the balls are positioned between the flanges 60 of the washer 52 as above described. As the balls move radially outwardly and then upwardly along the cam surface, the balls are moved apart so as to provide an opening therebetween for the pin shank 50 which, when continued to be moved upward, extends through the opening 66 in the flanged washer and the opening 48 in the insert. Both the flanged washer 52 and the insert 40 are likewise moved upwardly away from the closed end of the cup, with the diameter of the main body portion of the insert at the top thereof being slightly less than the diameter of the opening 32 of the cap so as to permit the insert to extend upwardly within such opening. Such upward movement is of course against the bias of the spring 42, which continually applies spring pressure to the insert and consequently to the flanged washer and retaining balls.

When the article to be secured to the tag and locking device is secured in place between the pin and the lock as shown in FIG. 1, the pin is released and the spring pressure from spring 42 acts downwardly on the insert and the flanged washer. The latter in turn urges the retaining balls downwardly along the cam surface formed by the upwardly extending side walls of the cup, into tight frictional engagement of the pin shank 50 thereby retaining the pin shank in place. It will be noted that when the pin is attempted to be withdrawn surreptitiously from the locking device, the pressure of the retaining balls on the pin shank is increased due to the cam surface provided by the side walls of the cup.

Figure 3:
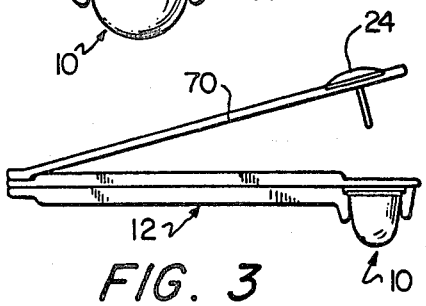
FIG. 3 is a side elevational view showing a modified form of identificaton tag in which the pin is carried by one of the tag sections.

Referring to FIG. 3, an alternative form of the invention is illustrated in which the tag assembly 12 includes a leg portion 70 which is hinged to the remainder of the tag body, with the leg 70 carrying the pin 24. In this arrangement, the entire leg is removed when the locking device is opened, thereby avoiding the separation of the pin from the lock so as to facilitate reuse of the tag and lock.

The assembly of the locking device can be quickly and easily effected. The balls 54 are placed at the bottom of the cup 22, with the flanged washer 52 next being placed in the cup above the balls. The insert 40 is then placed in the cup above the flanged washer, and the spring 42 positioned around the reduced diameter portion 44 of the insert. All of these parts are then moved into the cap, with the radial flange 56 of the cup being forced upwardly into the opening 34 at the bottom end of the housing. A tight frictional engagement of the cup within the housing is thereby achieved, and all parts are in their assembled position. The locking device can then be inserted in the tubular extension 14 of the tag assembly 12 as above described, thereby readying the lock for receiving the pin 50.

It will thus be seen that the invention is extremely simple in construction and easy to assemble. The smaller dimension and reduced machining of the insert, and the low manufacturing costs of the cup 22 and flanged washer 52 result in an inexpensive locking device, without, however, detracting from the efficient and positive locking achieved thereby.

It will be apparent that modifications of the disclosed invention can be made without departing from the invention concepts. For example, flanges comparable to flanges 60 on washer 52 can be provided at the periphery of the bottom end of the insert. In such event, the washer can be eliminated, with the bottom of the insert contacting the retaining balls directly. The washer can also be eliminated by forming the cup with a plurality of radially inwardly diverted and longitudinally extending projections on the tapered cam surface for arcuately spacing the balls within the cup.

Figure 5:
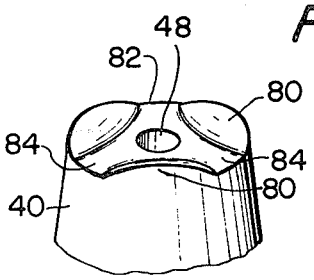
FIG. 5 is a fragmentary perspective view of the bottom of the insert, showing a modification of the invention.
Figure 6:
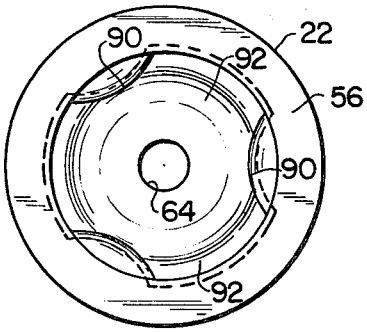
FIG. 6 is a top plan view of the cup, showing a further modification of the invention.
Figure 4:
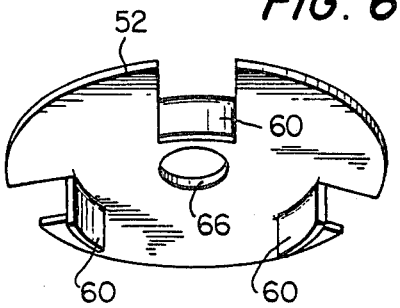
FIG. 4 is a bottom perspective view of the flanged washer which is positioned between the insert and the retaining balls.

The modifications just referred to are shown in FIGS. 5 and 6, respectively. Referring to FIG. 5, which shows the insert 40 in inverted form, downwardly and inwardly directed flanges commonly designated at 80 are formed on the periphery of the bottom surface 82 of the insert, with the edges of adjacent flanges defining therebetween channels commonly designated at 84. The balls 54 during insertion of the pin shank 50 through the opening 64 are thus confined to movement radially outwardly in the channels for engagement with the cam surfaces formed by the side walls of the cup, for pin retention under the bias of spring 42, as previously described.

FIG. 6 is a top plan view of the cup 22, showing arcuately spaced projections commonly designated at 90 formed therein. The projections 90 extend longitudinally from adjacent the bottom of the cup to a position above the uppermost position of travel of the bottom of the insert 48, whereby the balls 54 are at all times movable radially in channels 92 between the projections 90. The camming of the balls against the side walls of the cup is as previously described, with the pin shank 50 extending upwardly into the cup through opening 64.

We claim:

1. A locking device comprising a non-metallic housing substantially closed at one end and formed with a first axial recess and a relatively enlarged second axial recess at the opposite, open end of said housing; cup means the top of which is securely mounted in said enlarged recess in said housing, said cup means being formed with radially inwardly tapered side wall portions which form a cam surface, and an opening in the otherwise closed end thereof; an insert formed of magnetizable material loosely received within said housing and extending into said first axial recess, said insert being formed with an axial bore aligned with said opening in said cup means; a plurality of retaining balls disposed within said cup means below said insert, and means for arcuately spacing said balls, comprising a washer positioned between the bottom of said insert and said retaining balls, said washer being provided on its periphery with a least two downwardly extending, arcuately spaced flanges which serve to separate said retaining balls as they move upwardly along said cam surface; a pin adapted to extend upwardly through said aligned openings in said cup means and insert, said pin when so extended moving said insert upwardly in said housing and said retaining balls upwardly along said cam surface, and spring means for resiliently biasing said insert toward the open end of said housing, thereby causing said retaining balls to tightly frictionally engage said pin and retain the same in said locking device until said insert is again moved upwardly against the bias of said spring, by a detaching tool or the like, thereby permitting said pin to be released.

2. The locking device of claim 1 wherein there are three retaining balls and three downwardly depending flanges formed on said washer, with each retaining ball being arcuately spaced between adjacent downward flanges.

3. A locking device comprising a non-metallic housing substantially closed at one end and formed with a first axial recess and a relatively enlarged second axial recess at the opposite, open end of said housing; cup means the top of which is securely mounted in said enlarged recess in said housing said cup means being formed with radially inwardly tapered side wall portions which form a cam surface, and an opening in the otherwise closed end thereof; an insert formed of magnetizable material loosely received within said housing and extending into said first axial recess, said insert being formed with an axial bore aligned with said opening in said cup means; a plurality of retaining balls disposed within said cup means below said insert, and means for arcuately spacing said balls, comprising a plurality of downwardly depending, arcuately spaced flanges formed at the periphery on the bottom of said insert, said flanges defining channels therebetween through which said retaining balls travel for engagement with said cam surface when said insert is moved upwardly upon the insertion of a pin into said locking device; a pin adapted to extend upwardly through said aligned openings in said cup means and insert, said pin when so extended moving said insert upwardly in said housing and said retaining balls upwardly along said cam surface, and spring means for resiliently biasing said insert toward the open end of said housing, thereby causing said retaining balls to tightly frictionally engage said pin and retain the same in said locking device until said insert is again moved upwardly against the bias of said spring, by a detaching tool or the like, thereby permitting said pin to be released.

4. The locking device of claim 3 wherein there are three retaining balls and three downwardly extending flanges formed on said insert, arcuately spaced approximately equidistantly.

5. A locking device comprising a non-metallic housing substantially closed at one end and formed with a first axial recess and a relatively enlarged second axial recess at the opposite, open end of said housing; cup means the top of which is securely mounted in said enlarged recess in said housing, said cup means being formed with radially inwardly tapered side wall portions which form a cam surface, and an opening in the otherwise closed end thereof; an insert formed of magnetizable material loosely received within said housing and extending into said first axial recess, said insert being formed with an axial bore aligned with said opening in said up means; a plurality of retaining balls disposed within said cup means below said insert, and means for arcuately spacing said balls, comprising a plurality of longitudinal radially inwardly directed and arcuately spaced projections formed on the inner surface of said cup, said projections defining channels therebetween through which said retaining balls travel for engagement with said cam surface when said insert is moved upwardly upon the insertion of a pin into said locking device; a pin adapted to extend upwardly through said aligned openings in said cup means and insert, said pin when so extended moving said insert upwardly in said housing and said retaining balls upwardly along said cam surface, and spring means for resiliently biasing said insert toward the open end of said housing, thereby causing said retaining balls to tightly frictionally engage said pin and retain the same in said locking device until said insert is again moved upwardly against the bias of said spring, by a detaching tool or the like, thereby permitting said pin to be released.

6. The locking device of claim 5 wherein there are three retaining balls and three projections formed on said cup, with each retaining ball being arcuately spaced between adjacent projections.

7. The locking device of claim 1 wherein said cup means is formed at the open end thereof with a laterally extending annular flange, the outside diameter of said flange and the diameter of said enlarged second axial recess in said housing being such that when said cup means is moved upwardly into said second recess a tight frictional engagement of said cup means in said enlarged recess is achieved.

8. The locking device of claim 1 wherein said insert includes a reduced diameter upper end around which said spring means extends, and a main body portion tapered to permit reciprocating movement thereof without interference with the tapered side wall portions of said cup means.

9. A locking device comprising a non-metallic housing substantially closed at one end and formed with a first axial recess and a relatively enlarged second axial recess at the opposite, open end of said housing; cup means the top of which is securely mounted in said enlarged recess in said housing, said cup means being formed with radially inwardly tapered side wall portions which form a cam surface, and an opening in the otherwise closed end thereof; an insert formed of magnetizable material loosely received within said housing and extending into said first axial recess, said insert being formed with an axial bore aligned with said opening in said cup means; a plurality of retaining balls disposed within said cup means below said insert, and means for arcuately spacing said balls and defining radially extending open channels through which said balls can freely pass for engagement with said side wall portions of said cup means; a pin adapted to extend upwardly through said aligned openings in said cup means and insert, said pin when so extended moving said insert upwardly in said housing and said retaining balls radially outwardly through said channels and upwardly along said cam surface, and spring means for resiliently biasing said insert toward the open end of said housing, thereby causing said retaining balls to tightly frictionally engage said pin and retain the same in said locking device until said insert is again moved upwardly against the bias of said spring, by a detaching tool or the like, thereby permitting said pin to be released, said spacing means precluding annular movement of said balls in said cup means when said pin is moved upwardly into said locking device.

* * * * *